United States Patent [19]

Hoya

[11] Patent Number: 4,805,423

[45] Date of Patent: Feb. 21, 1989

[54] DEVICE FOR ACTUATING MOVABLE CAMS IN A FLAT KNITTING MACHINE

[75] Inventor: Fernando Hoya, Couvet, Switzerland

[73] Assignee: Edouard Dubied & Cie. S.A., Couvet, Switzerland

[21] Appl. No.: 127,039

[22] Filed: Nov. 27, 1987

[30] Foreign Application Priority Data

Dec. 1, 1986 [CH] Switzerland ..... 4783/86

[51] Int. Cl.[4] ..... D04G 7/00

[52] U.S. Cl. ..... 66/78

[58] Field of Search ..... 66/75.1, 75.2, 78

[56] References Cited

U.S. PATENT DOCUMENTS 3,066,509 12/1962 Kempf ..... 66/75.1
4,180,992 1/1980 Schieber et al. ..... 66/75.1
4,502,300 3/1985 Schimko et al. ..... 60/78

FOREIGN PATENT DOCUMENTS 699053 11/1979 U.S.S.R. ..... 60/75.1

*Primary Examiner*—Ronald Feldbaum
*Attorney, Agent, or Firm*—Lewis H. Eslinger; Jay H. Maioli

[57] ABSTRACT

A device for actuating movable cams for use on a flat knitting machine that includes several cams arranged on a cam plate, in which the cams are movable in a direction perpendicular to the plane of movement of the cam box, contains a drum having an axis of rotation that is perpendicular to the plane of movement of the cam box and that is located substantially central relative to all movable cams. The drum includes grooves in the peripheral portion thereof at axial distances from one another, which grooves have variable axial positions over the periphery of the drum. A corresponding engaging part rides in a respective groove and the drum is rotated by a drum mechanism through definite angular amounts so that cams are placed in or out of activity at a stroke of the engaging part in the groove by means of connecting bars assigned to each of the engaging parts riding in the grooves on the drum.

7 Claims, 7 Drawing Sheets

DEVICE FOR ACTUATING MOVABLE CAMS IN A FLAT KNITTING MACHINE

BACKGROUND OF THE INVENTION

1. Field of the Invention

This invention relates generally to a device for actuating movable cams in a flat knitting machine and, more particularly, to a device for actuating movable cams in a flat knitting machine of the kind having a cam plate and several cams arranged thereon, which cams are movable in a direction substantially perpendicular to a plane of movement of the cam box.

2. Description of the Background

Flat knitting machines are known that have a cam plate and several cams arranged thereon, which cams are movable in a direction perpendicular to the plane of movement of the cam box. The cams are also movable perpendicularly to each of a number of grooves that are formed in a carrier and that cooperate with an engaging element, which run along such grooves. Each engaging element is mounted on a rod that is firmly attached to the respective cam involved, and the carrier is attached to a control shaft that is reversibly driven through predetermined angles.

There are various actuating approaches already known for this kind of flat knitting machine and such actuating procedures are generally divided into the use of mechanical actuating means on the one hand and electro-mechanical actuating means on the other. In both cases, however, the cams of the cam box used for such actuation purposes are generally movable perpendicularly to the plane of movement of the needles in flat knitting machines.

In the case of a purely mechanical device used to actuate the cams, the movement of the movable cams is brought about by fixed studs arranged at the machine end that operate upon the stroke reversal of the carriage, as it moves back and forth. In this fashion, the cams involved assume their desired positions by means of curved guides, which require expensive intermediate elements and other costly mechanical parts.

In the case of electromechanical devices used for the actuating of cams, a distinction must be made between those which use electromagnetic correcting elements and those that make use of stepping motors and the like. Furthermore, it should be noted that electromechanical solutions present a further advantage in that they are particularly applicable for flat knitting machines of the kind that have a variable carriage stroke.

In a system disclosed in German Patent Publication DE-OS No. 2,111,789, a separate electromagnet is installed for each movable cam. The electromagnet is arranged so that no forces result in the stroke direction of the electromagnet, in order to prevent the occurrence of unwanted disturbances to the knitting operation during operation of the machine.

Another solution to the movable cams problem is disclosed in German Patent Publication DE-OS No. 2,622,347, in which the cams cooperate with a number of disks having cam-contoured grooves. The disks are jointly arranged on a control shaft, which can be rotated into predetermined angular positions by means of a stepping motor. The actuation of the cams is accomplished individually or in groups by rotating the control shaft in a manner that is predetermined by the corresponding camcontoured grooves. This system has a particular disadvantage in that it is not suitable for a large number of movable cams, both because of the mechanical expense due to the number of parts and also to the large physical space that is required by this large number of cams. The space problem is particularly problematic if the cams must lie close together in that knitting machine.

OBJECTS AND SUMMARY OF THE INVENTION

Accordingly, it is an object of the present invention to provide a device for actuating movable cams in a flat knitting machine that can eliminate the above-noted defects inherent in the prior art.

Another object of this invention is to provide a device for actuating cams in a flat knitting machine in which the actuation of a relatively large number of cams, which are arranged centrally in the cam box can be designed with a substantially dense packing arrangement.

In accordance with an aspect of the present invention such device is provided that includes a drumshaped carrier on which grooves are formed on the peripheral surface thereof at an axial distance from one another and which have variable axial positions over the position of the drum. In this fashion, the axis of rotation of the drum is arranged perpendicularly to the plane of movement of the cam box and is located substantially centrally with respect to all movable cams.

The above and another objects, features, and advantages of the present invention will become apparent from the following detailed description of illustrated embodiments thereof to be read in conjection with the accompanying drawings, in which like reference numerals represent the same or similar elements.

DETAILED DESCRIPTION OF PREFERRED EMBODIMENTS

Figure 1:
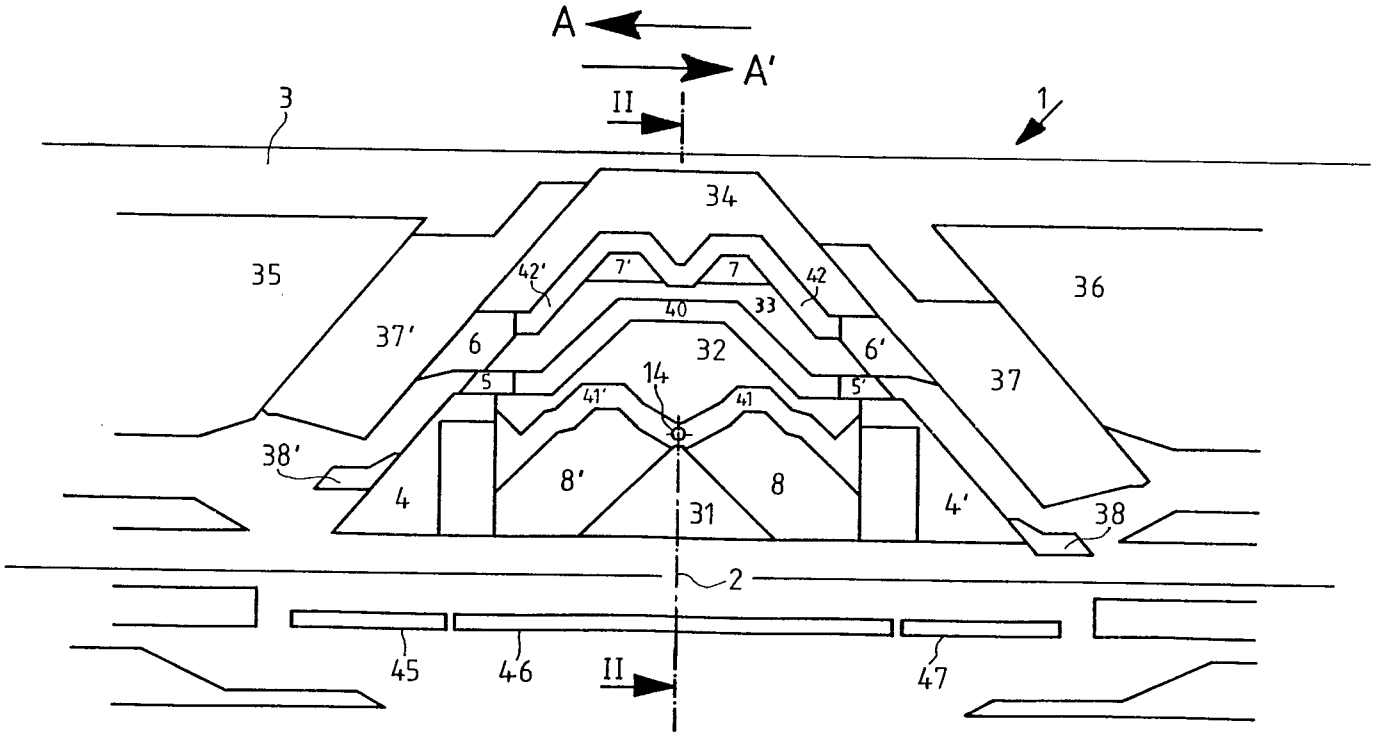
FIG. 1 is a top plan view of a cam box assembly of a flat knitting machine provided with a device according to an embodiment of the present invention for actuating cams.

In FIG. 1, a front cam plate 3 facing the needle bed of a cam box 1, as found in a flat knitting machine, is shown in top plan view. It is to this front cam plate 3 that the individual elements of the device for actuating the movable cams are attached.

These cams are both firmly attached and movably arranged, that is, they are movable, and the cams in the currently common combined cam box 1 are both for knitting and stitch transfers. The cams are arranged symmetrically in cam box 1, with reference to a longitudinal unit plane 2.

The cams 31, 32, 33, 34, 35, 36, are firmly attached to cam plate 3 and serve mainly as safety elements and also to form the different cam paths with the movable cams. The stitch cams 37, 37', for adjusting the stitch size, are movable parallel to the plane of movement of the needles. Stitch cams 37, 37', are arranged in cam box 1 in a known way and do not have any connection with the device provided by the present invention. Stitch cams 37, 37' work independently of the elements provided by the present invention.

Guard cams 38, 38' are movable both parallel and perpendicular to the plane of movement of the needles and as will be set forth below, these elements are connected with the device according to the present invention only in an indirect manner.

In regard to a course direction A of a carriage, not shown in detail, on which cam box 1 is connected with cam plate 3, functional and structural distinctions are made among a rising cam 4, a first closing cam 5, a second closing cam 6, a protuberant cam 7, and a reception cam 8. It will be understood that corresponding cams 4', 5', 6', 7', and 8' are provided for the course moving in the opposite direction.

Figure 2:
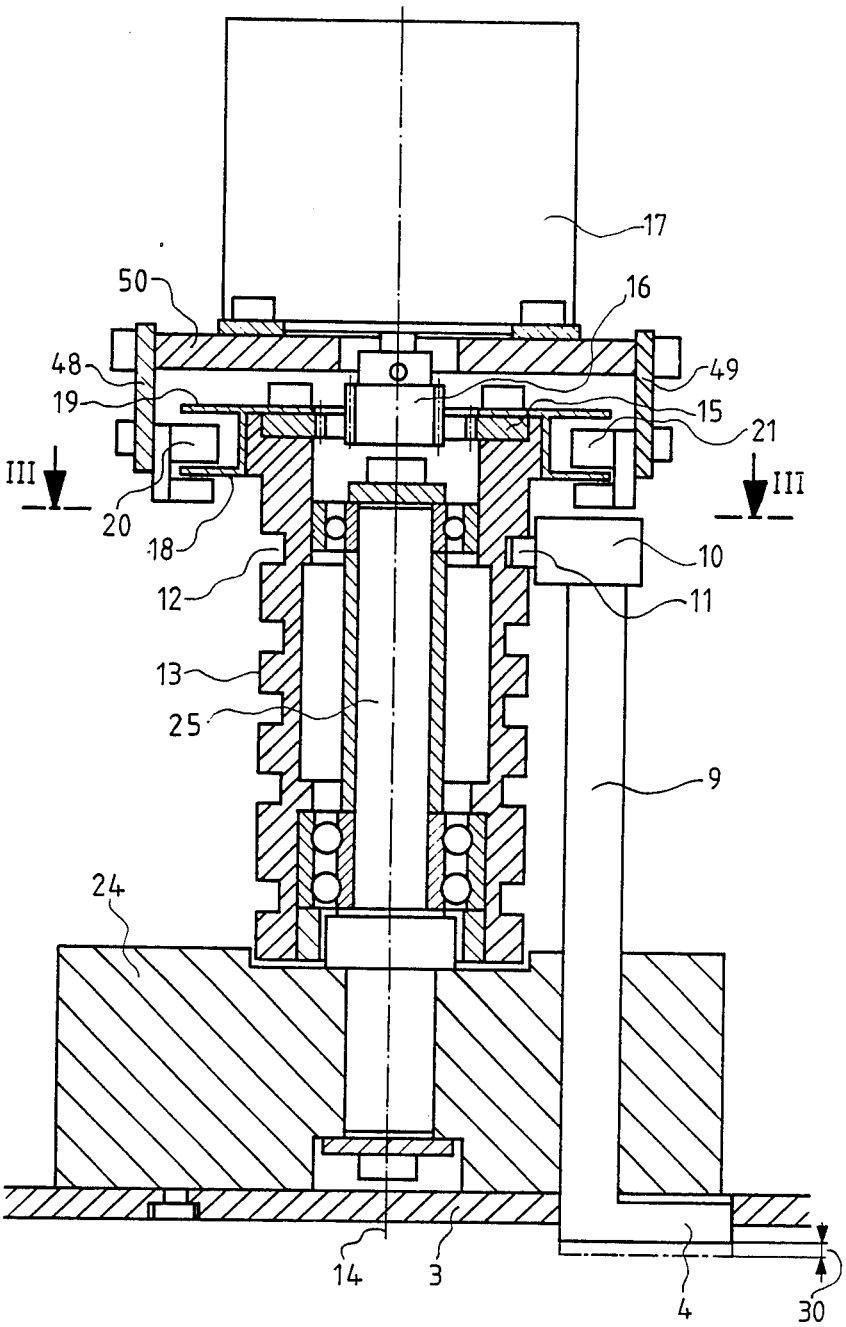
FIG. 2 is a cross-sectional view taken along section lines II—II of FIG. 1, with one of the movable cams shown in detail.
Figure 3:
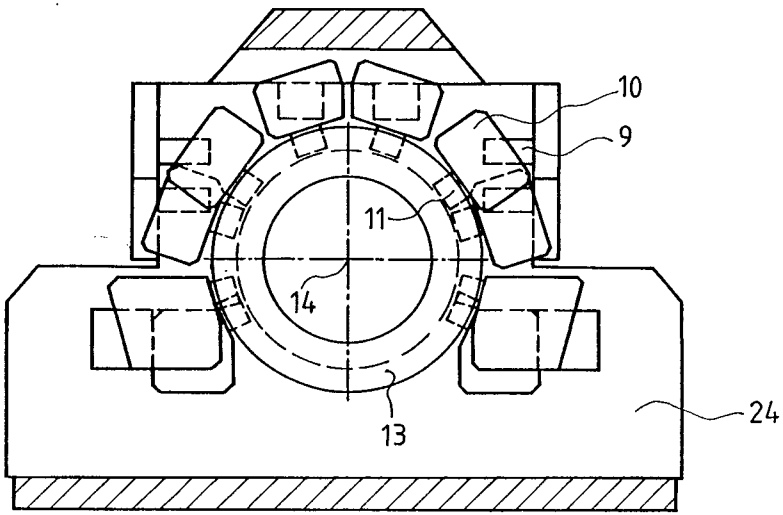
FIG. 3 is a cross-sectional view taken along section lines III—III in FIG. 2, in which the elements are shown in a somewhat simplified form.
Figure 4:
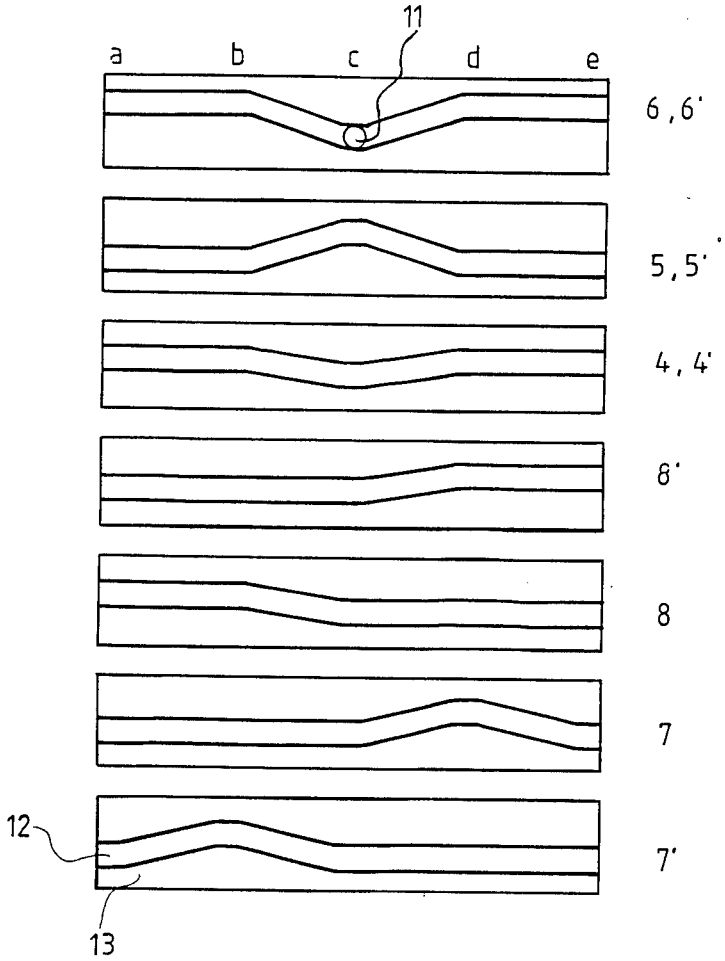
FIG. 4 is a schematic representation of the positions that a drum cam assume.

Each of the above-mentioned movable cams is firmly attached to a respective, generally bar-shaped, guidance part 9, as shown in FIGS. 2 and 3, that is arranged substantially perpendicularly to cam plate 3. An activation pin 11 engages in a respective one of a number of circular grooves 12 formed in drum 13, and pin 11 is located at an end 10 of increased dimensions arranged at one end of bar 9 that is provided for the respective cam involved. These movable cams can assume two precisely determined positions upon each passage of the cam box, that is, a working position in which the butts of knitting elements (not shown) can engage, and a nonworking position, in which the butts of such knitting elements cannot engage.

A number of grooves 12 are arranged on the periphery of the drum 13 that is mounted for rotary motion on a cam plate 3 and that has its center 14 located within the effective radius of the cams, as represented in FIG. 1, for example. Drum 13 is shown in FIG. 2 as mounted by ball bearings on a shaft 25 that is attached to a housing 24. Housing 24 also contains guides for bars 9 that bear the cams, and housing 24 is mounted on cam plate 3, as shown in FIG. 2.

Figure 5:
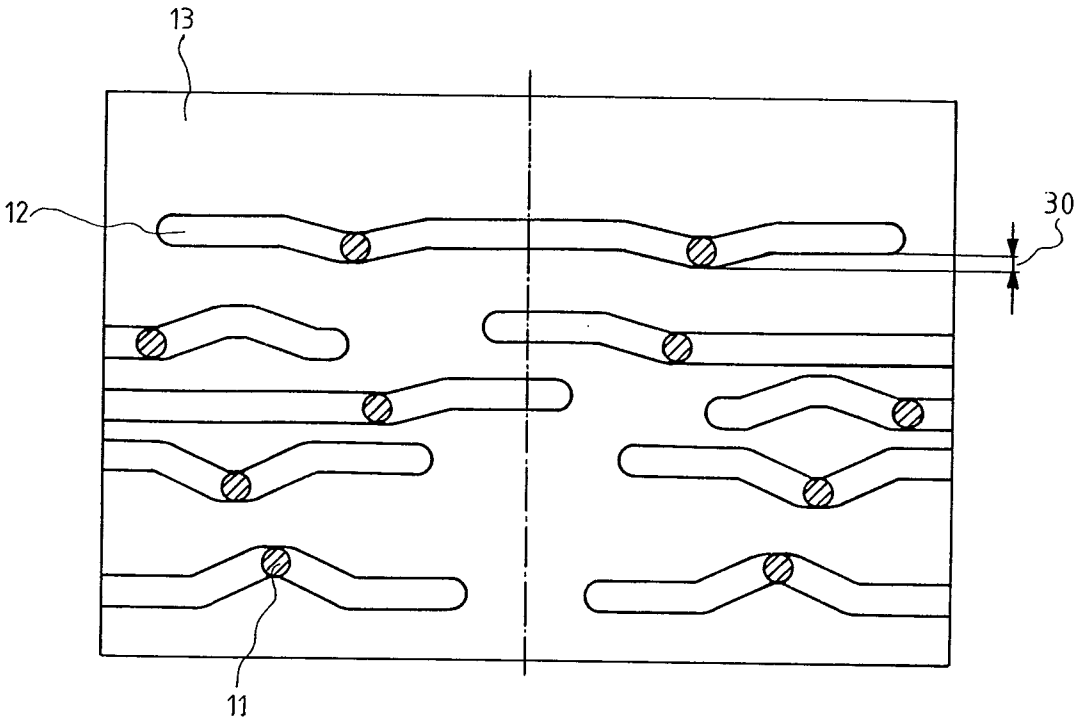
FIG. 5 is a development of the peripheral surface of the drum corresponding to a position c, as shown in FIG. 4.

Referring now to FIG. 5, which is a development of the periphery of connection drum 13, grooves 12 are subdivided into tracks, which are located in several planes parallel to the axis of rotation 14 of drum 13.

The movable cams are each assigned to a respective individual track in such a way that a corresponding activation pin 11 engages in the corresponding respective groove 12. In the embodiment shown herein, a total of ten cams are attached, which make use of a total of five paths or tracks 12 on connection drum 13.

Turning back to FIG. 2, drum 13 is mounted to be rotated by a power transmission agent, which in this embodiment is a stepping motor 17, by means of inner gear rim 15 and a driving pinion 16, which is mounted on the drive shaft of stepping motor 17. By use of stepping motor 17 it is possible to shift drum 13 by definite and precise angular amounts. The active length of groove 12 for each cam amounts to an angular extent of 144° on the periphery of drum 13 and, in this embodiments, requires 160 actuation steps of motor 17 to achieve the desired result. The axial formation of grooves 12 corresponds to stroke 30, that is, the extent of travel to be transmitted to the movable cam through pin 11, as represented in FIGS. 2 and 5.

Figure 6:
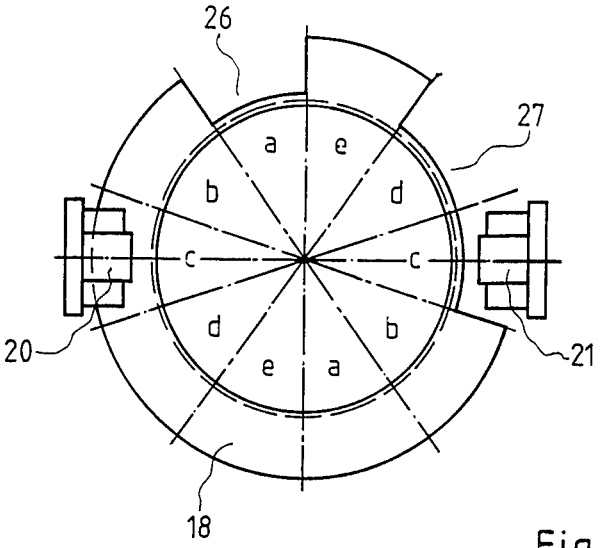
FIG. 6 is a top plan view of a lower control disk employed in the embodiment of FIG. 2.
Figure 7:
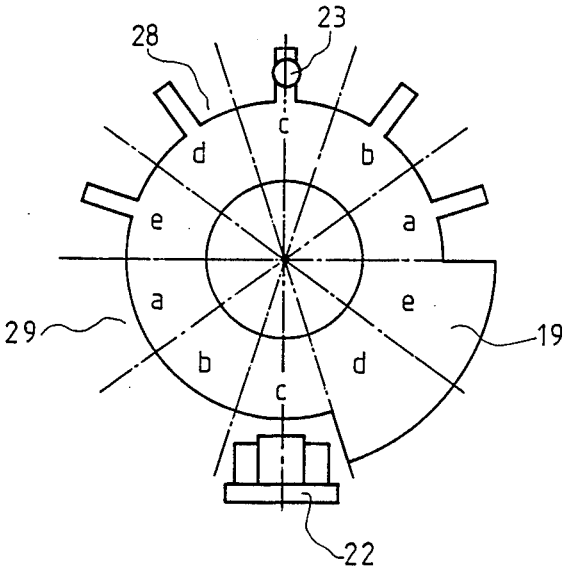
FIG. 7 is a top plan view of an upper control disk employed in the embodiment of FIG. 2.

As shown in FIG. 2, to control the precise and correct angular position of drum 13, two control disks 18, 19 are attached at the upper end of drum 13, and these disks 18, 19 are scanned without contact by proximity detectors or switches 20, 21, 22, 23. Proximity switches are attached to housing 24 by respective mounting brackets 48, 49, 50. These switches may be comprised of magnetic or optical detectors. The shape of the lower control disk is shown in FIG. 6 and includes two notches 26 and 27 in its periphery. Similarly, upper control disk 19 is shown in FIG. 7 and includes notches 28 and 29 in its periphery. The combination of these two disks 18, 19 make possible a definite recognition of different sector positions about drum 13. Each disk is divided in half by a diametric line and each half includes sectors designated as a, b, c, d, and e, so that in a given case for the three switches 20, 21, and 22 being arranged mutally separated by 90° on the periphery of the disk, it is possible to recognize the desired sector. Notches 28 on the upper half of control disk 19 cooperate with switch or detector 23 and aid in making the recognition of the precise position of drum 13 possible.

The device for actuating movable cams in a flat knitting machine according to the present invention as described above operates as follows. Stepping motor 17 is activated at one of the stroke reversal points of the carriage that is moving back and forth, in which one or more cam boxes 1 that have movable cams is accommodated, whereby a number of rotary steps are performed in either a clockwise or counterclockwise position. More specifically, one rotary turning causes drum 13, which is connected to stepping motor 17 by means of gears 15, 16 to either place the attached means in or out of activity individually or in a certain combination, according to the specific design of grooves 12, arranged on the periphery of drum 13. It will be understood that the process described is also correspondingly repeated at the opposite stroke reversal point of the knitting carriage as it moves back and forth.

For example, in position or sector c out of the five possible angle positions a, b, c, d, e of drum 13, cams 5, 5' are withdrawn out of activity, but on the other hand, cams 6, 6', 4, 4', 8, 8', and 7, 7' are lowered and are active.

In position b of drum 13, cams 6, 6', 4, 4', 8 and 7' are withdrawn and cams 5, 5', 8' and 7 are lowered and are active. This causes the needles selected in direction of course A to reach cam path 42 with full-butt height to accomplish stitch transfer, but on the other hand, the needles selected with the half-butt height reach cam path 41 for stitch reception.

At position d of drum 13, cams 6, 6', 4, 4', 8' and 7 are withdrawn and cams 5, 5', 8, and 7' are lowered, which leads the needles selected to reach cam path 42' with full-butt height for stitch transfer in direction of course A' but, on the other hand, the needles selected with half-butt height reach cam path 41' for stitch reception.

Position a of connection drum 13 corresponds to position b, with the difference that protuberance cam 7' is also actuated for stitch transfer. Similarly, position e is the analog of position d.

It must be understood that because a flat knitting machine with individual needle selection is involved in the above-described embodiment, so-called pressure cams 45, 46, 47 are also contained in the cam box. These cams serve to permit additional selection combinations, for example the tucking position of the needles.

Figure 8:
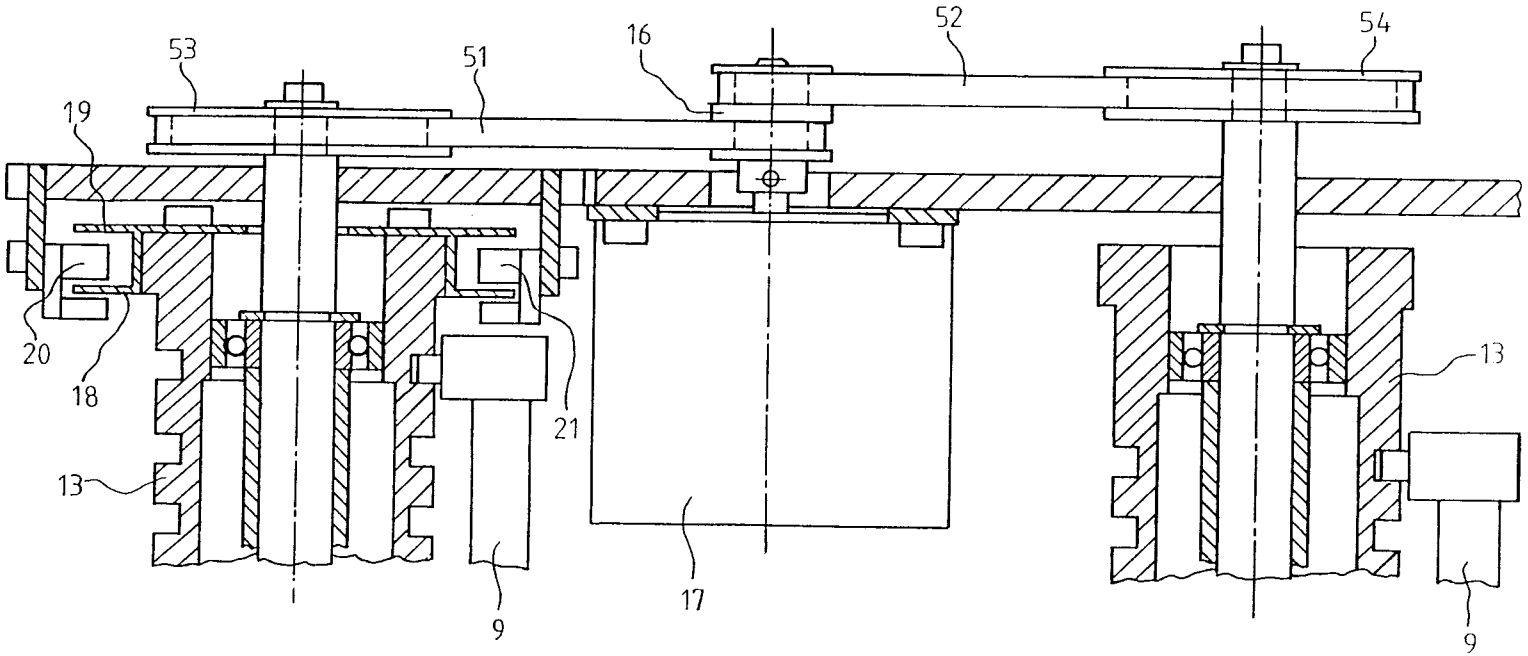
FIG. 8 is a cross-sectional view of two drums with a common power transmission agent, such as a stepping motor.

If adjacent cam boxes are equipped with more limited stitch transfer possibilities, and the number of movable cams is consequently smaller, it is possible to drive drums 13 of at least two cam boxes located one beside each other with a common stepping motor 17. This arrangement is shown in FIG. 8 in which it is seen that by use of drive connections 16, 51, 52, 53, and 54 which are slip-less gear wheels and gear belts, that is, toothed timing belts that will not slip. Accordingly, this arrangement is sufficient to require control disks 18, 19 and proximity switches 20, 21, 22, 23 on only one of the two drums, as shown in FIG. 8 on the drum at the left hand side of the drawing.

The above description is given on a single preferred embodiment of the invention, but it will be apparent that many modifications and variations could be effected by one skilled in the art without departing from the spirit or scope of the novel concepts of the invention, which should be determined by the appended claims.

What is claimed is

1. Device for actuating movable cams of a flat knitting machine having a cam plate and a plurality of cams arranged thereon, said cams being movable in a direction substantially perpendicular to the plane of movement of the cam box, and to each of which a groove designed on a carrier and an engaging part running in the groove are assigned, which is mounted on a rod firmly attached to a cam involved, whereby said carrier is attached to a control shaft driven reversibly at a definite angle, characterized by the fact that the carrier is a drum on which grooves are formed in the peripheral portion of said drum at an axial distance from each other and with selected axial positions over the periphery of said drum, an axis of rotation of drum being perpendicular to the plane of movement of the cam plate and being located substantially centrally with respect to said movable cams.

2. A device in accordance with claim 1, characterized by the fact that said drum is shifted in angular movement by a stepping motor.

3. A device in accordance with claim 1, characterized by the fact that the axial positions of said grooves in said drum are selected so that two distinct positions of said movable cams are reached, i.e., in operation and not in operation.

4. A device in accordance with claim 1 or 3, characterized in that bars of the movable cams are set in a common housing to achieve a precise guidance.

5. Device in accordance with claim 2, characterized in that said stepping motor is arranged in rotary connection with said drum by a reducing gear unit consisting of an inner gear rim and a driving pinion.

6. Device in accordance with claim 1, 3, or 5, characterized in that said drum is provided with two control disks mounted at an axial distance from said grooves and proximity detectors are arranged for cooperating with said disks for detecting an extent of angular rotation thereof.

7. Device in accordance with claim 2, characterized in that said stepping motor drives more than one drum by means of slip-free driving connections.

* * * * *